US012768586B2

(12) United States Patent
Allgeier et al.

(10) Patent No.: US 12,768,586 B2
(45) Date of Patent: Oct. 20, 2026

(54) STORAGE DRAWER ASSEMBLY FOR A REFRIGERATOR APPLIANCE

(71) Applicant: Haier US Appliance Solutions, Inc., Wilmington, DE (US)

(72) Inventors: Brian Allgeier, Louisville, KY (US); Louis A. Wantland, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 243 days.

(21) Appl. No.: 18/678,890

(22) Filed: May 30, 2024

(65) Prior Publication Data

US 2025/0369685 A1 Dec. 4, 2025

(51) Int. Cl.
*F25D 25/02* (2006.01)
*F25D 23/02* (2006.01)

(52) U.S. Cl.
CPC ..... *F25D 25/025* (2013.01); *F25D 25/024* (2013.01); *A47B 2210/08* (2013.01); *F25D 23/02* (2013.01); *F25D 2325/021* (2013.01)

(58) Field of Classification Search
CPC ..... F25D 25/025; F25D 25/024; F25D 23/02; F25D 2325/021; A47B 2210/08; A47B 2210/175
See application file for complete search history.

(56) References Cited

U.S. PATENT DOCUMENTS

| | | | | |
|---|---|---|---|---|
| 4,732,435 | A * | 3/1988 | Bailey | F25D 25/025 312/274 |
| 8,011,744 | B2 * | 9/2011 | Lim | A47B 96/02 312/311 |
| 9,228,776 | B2 | 1/2016 | Burke et al. | |
| RE46,029 | E | 6/2016 | Nam et al. | |
| 9,367,984 | B2 * | 6/2016 | Daugbjerg | E05B 65/46 |
| 10,132,558 | B2 | 11/2018 | Eveland et al. | |
| 10,465,975 | B2 | 11/2019 | Hwang et al. | |
| 10,571,184 | B2 | 2/2020 | Ogg | |
| 10,823,492 | B2 | 11/2020 | Oh | |

(Continued)

FOREIGN PATENT DOCUMENTS

| | | | | |
|---|---|---|---|---|
| CA | 2924894 C | * | 6/2022 | A23B 2/10 |
| CN | 203534050 U | * | 4/2014 | F25D 25/025 |

(Continued)

*Primary Examiner* — Kimberley S Wright
(74) *Attorney, Agent, or Firm* — Dority & Manning, P.A.

(57) ABSTRACT

A refrigerator appliance may include a cabinet defining a chamber. The refrigerator appliance may include a storage drawer assembly positioned within the chamber. The storage drawer assembly may include a drawer defining a storage compartment. The storage drawer assembly may include a lid assembly positioned above the drawer. The lid assembly may include a cover positioned above the drawer. The cover may include a first side support and a second side support. The storage assembly may include a first lid moveably mated to the cover to selectively permit access to the storage compartment. The storage assembly may include a second lid moveably mated to the cover to selectively permit access to the storage compartment. The first lid and the second lid may define an axis of rotation extending parallel to the lateral direction. The axis of rotation being positioned proximate to a rear of the lid assembly.

19 Claims, 14 Drawing Sheets

(56) References Cited

U.S. PATENT DOCUMENTS

| | | | | |
|---|---|---|---|---|
| 10,928,124 | B2 | 2/2021 | Shin et al. | |
| 2005/0236947 | A1 * | 10/2005 | LeClear | A47B 71/00 312/404 |
| 2018/0022507 | A1 * | 1/2018 | Weiss | B65D 43/163 206/281 |

FOREIGN PATENT DOCUMENTS

| | | | | |
|---|---|---|---|---|
| CN | 103851871 | A | 6/2014 | |
| CN | 109855343 | B | 4/2021 | |
| DE | 202006009096 | U1 * | 10/2007 | A47B 88/969 |
| EP | 2422150 | B1 | 1/2013 | |
| JP | 6072633 | B2 | 2/2017 | |
| KR | 20210081635 | A * | 7/2021 | F25D 25/025 |
| WO | WO2010099284 | A2 | 9/2010 | |
| WO | WO-2020052519 | A1 * | 3/2020 | F25D 23/02 |
| WO | WO-2023008735 | A1 * | 2/2023 | F25D 25/024 |

* cited by examiner

STORAGE DRAWER ASSEMBLY FOR A REFRIGERATOR APPLIANCE

FIELD OF THE DISCLOSURE

The present subject matter relates generally to a refrigerator appliance, and more particularly to a storage drawer assembly for a refrigerator appliance.

BACKGROUND OF THE DISCLOSURE

Refrigerator appliances generally include a cabinet that defines one or more chilled chambers for receipt of food articles for storage. Typically, one or more doors are rotatably hinged to the cabinet to permit selective access to food items stored in the chilled chamber. Further, refrigerator appliances commonly include one or more storage bins or drawers positioned within the chilled chamber. Food items, or various other items, that require refrigeration may be placed within the storage drawers, e.g., for organization or compartmentalization of items that require refrigeration.

Challenges currently exist related to the storage drawers of refrigerator appliances. Specifically, storage bin or drawers can be difficult for a user to access due to space constraints caused by the doors of the refrigerator appliance. For example, when a refrigerator appliance includes two doors that are rotatably hinged to the cabinet, access to the storage drawers can be inhibited when only one of the two doors is open. For example, the closed door may inhibit the functionality of the storage bin or drawer. This difficulty in using the storage drawer can lead to user dissatisfaction or frustration.

Accordingly a refrigerator appliance that obviates one or more of the above-mentioned drawbacks would be beneficial.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a refrigerator appliance is provided. The refrigerator appliance may define a vertical direction, a lateral direction, and a transverse direction, The refrigerator appliance may include a cabinet. The cabinet may define a chilled chamber. The refrigerator appliance may include a storage drawer assembly positioned within the chilled chamber. The storage drawer assembly may define a first side and a second side spaced apart along the lateral direction. The storage drawer assembly may include a drawer positioned at a bottom wall of the cabinet. The drawer may define a storage compartment. The storage drawer assembly may include a lid assembly positioned above the drawer. The lid assembly may include a cover. The cover may include a first side support and a second side support spaced apart along the lateral direction. The lid assembly may include a first lid moveably mated to the first side support. The lid assembly may include a second lid moveably mated to the second side support. The first lid and the second lid may together define an axis of rotation positioned proximate a rear end of the lid assembly. The axis of rotation may extend parallel to the lateral direction. The first lid and the second lid may together be moveable relative to the first side support and the second side support between a fully closed position and a tucked position. The first lid is rotatable about the axis of rotation independent of the second lid between the closed position and a first flipped position. The second lid may be rotatable about the axis of rotation independent of the first lid between the closed position and a second flipped position.

In another exemplary aspect of the present disclosure, a refrigerator appliance is provided. The refrigerator appliance may include a cabinet. The cabinet may define a chamber. The refrigerator appliance may include a storage drawer assembly positioned within the chamber. The storage drawer assembly may include a drawer defining a storage compartment. The storage drawer assembly may include a lid assembly positioned above the drawer. The lid assembly may include a cover positioned above the drawer. The cover may include a first side support and a second side support. The storage assembly may include a first lid moveably mated to the cover to selectively permit access to the storage compartment. The storage assembly may include a second lid moveably mated to the cover to selectively permit access to the storage compartment. The first lid and the second lid may define an axis of rotation extending parallel to the lateral direction. The axis of rotation being positioned proximate to a rear of the lid assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
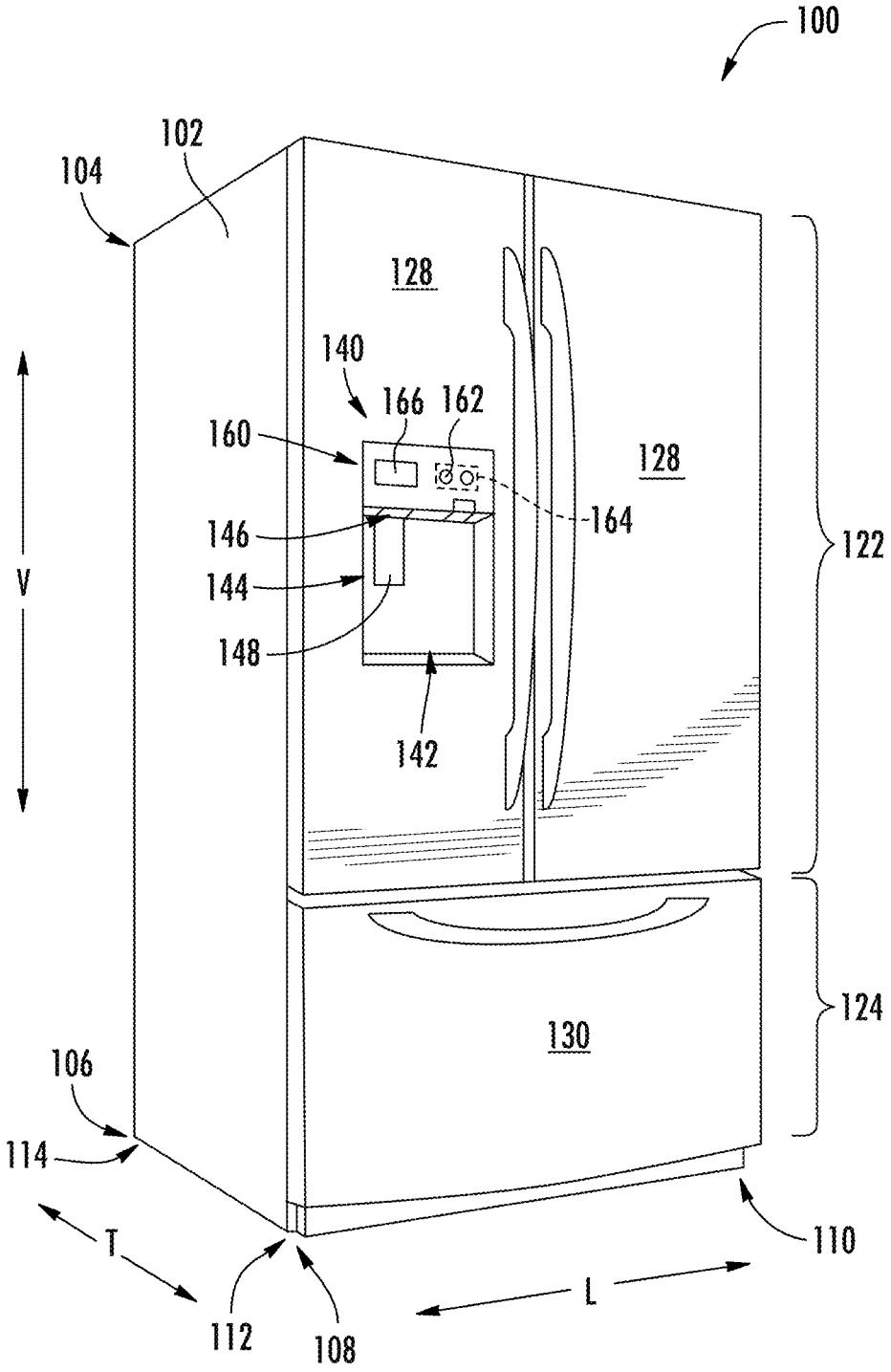
FIG. 1 provides a perspective view of a refrigerator appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Referring now to the figures, FIG. 1 provides a perspective view of a refrigerator appliance 100 according to one or more exemplary embodiments of the present subject matter. The refrigerator appliance 100 may define a vertical direction V, a lateral direction L, and a transverse direction T. Each of the vertical direction V, lateral direction L, and transverse direction T being mutually perpendicular to one another to form an orthogonal coordinate system. Refrigerator appliance 100 may include a housing or a cabinet 102 that may extend between a top 104 and a bottom 106 along the vertical direction V, between a first side 108 and a second side 110 along the lateral direction L, and between a front side 112 and a rear side 114 along the transverse direction T.

Cabinet 102 may define one or more chilled chambers for receipt of food items for storage. In particular, cabinet 102 may include a fresh food liner 121 positioned at or adjacent top of the cabinet 102 and a freezer liner 123 arranged at or adjacent bottom 106 of the cabinet 102. The fresh food liner 121 may define a fresh food chamber 122 for the receipt of food items that require refrigeration. The freezer liner 123 may define a freezer chamber 124 for the receipt of food items that require freezing. As such, the refrigerator appliance 100 may generally be referred to as a bottom mount or French door refrigerator appliance. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein may be for illustrative purposes only and is not intended to be limiting in any aspect to any particular refrigerator chamber configuration.

The refrigerator appliance 100 may include refrigerator doors 128 that may be rotatably hinged to an edge of cabinet 102 for selectively accessing the fresh food chamber 122. In addition, a freezer door 130 may be arranged below the refrigerator doors 128 for selectively accessing the freezer chamber 124. Freezer door 130 may be coupled to a freezer drawer (not shown) that may be slidably mounted within freezer chamber 124. Refrigerator doors 128 and freezer door 130 may be shown in the closed configuration in FIG. 1. One skilled in the art will appreciate that other chamber and door configurations are possible and within the scope of the present invention.

Figure 2:
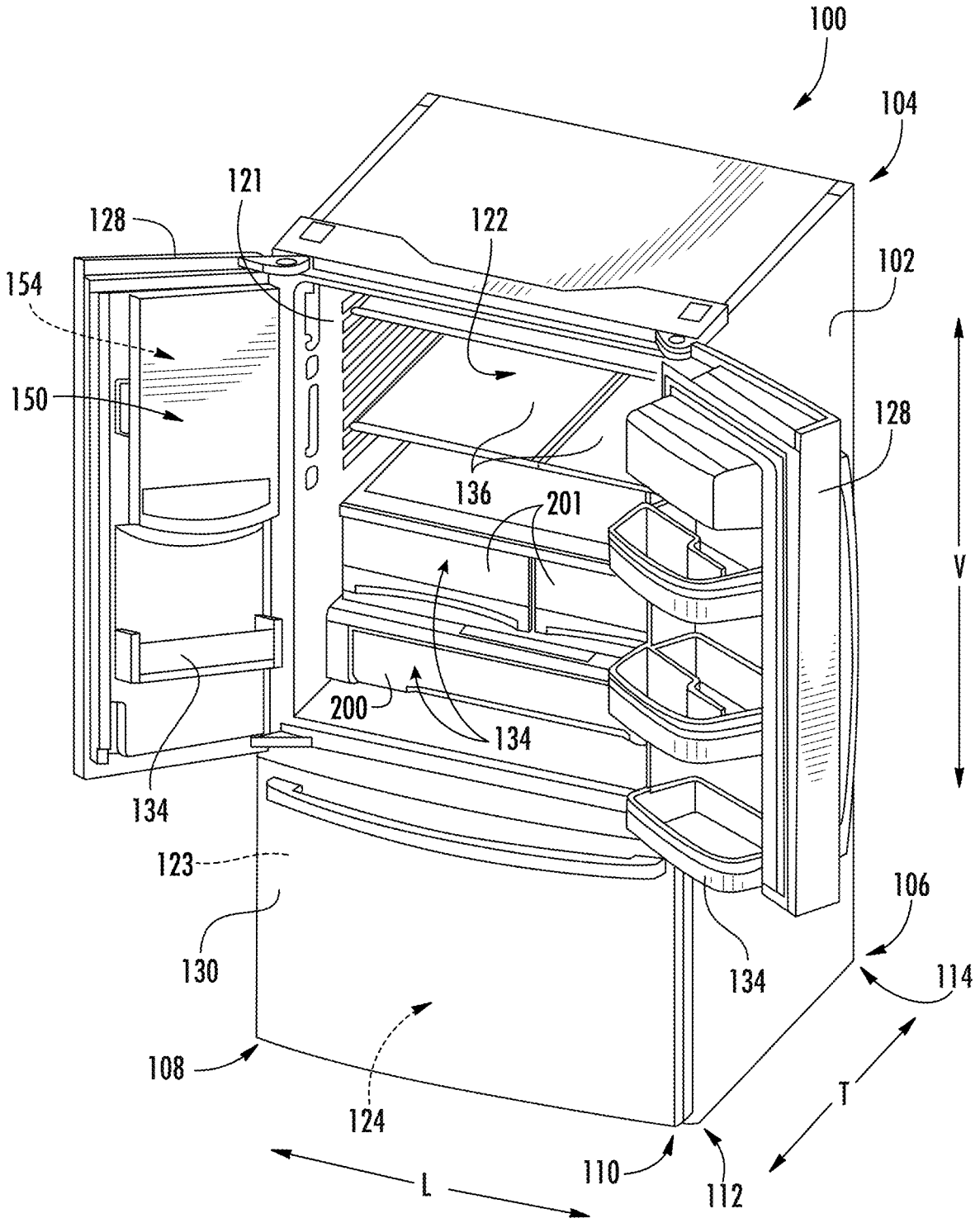
FIG. 2 provides a perspective view of the exemplary refrigerator appliance of FIG. 1, with the doors of the fresh food chamber shown in an open position.

Referring now to FIG. 2, a perspective view of the refrigerator appliance 100 shown with the refrigerator doors 128 in the open position is provided. As shown in FIG. 2, various storage components may be mounted to the fresh food liner 121, e.g., within fresh food chamber 122, to facilitate storage of food items therein as will be understood by those skilled in the art. In particular, the storage components may be defined by one or more drawers 134 or one or more shelves 136. In some embodiments, the one or more drawers 134 include a storage drawer assembly 200 (e.g., described in more detail below) positioned at a bottom of the fresh food liner 121. Additionally or alternatively, in some embodiments, the one or more drawers include a pair of half width storage drawers 201 positioned above (e.g., directly, or indirectly) the storage drawer assembly 200.

Each of these storage components are configured for receipt of food items (e.g., beverages or solid food items, etc.) and may assist with organizing such food items. As illustrated, drawers 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 may generally be configured for dispensing liquid water or ice pieces. Although an exemplary dispensing assembly 140 may be illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 may be positioned at a predetermined elevation convenient for a user to access ice and enabling the user to access ice without the need to bend-over. In the exemplary embodiment, dispenser recess 142 may be positioned at a level that approximates the chest level of a user.

Dispensing assembly 140 may include an ice dispenser 144 that may include a discharging outlet 146 for discharging ice pieces from dispensing assembly 140. An actuating mechanism 148, shown as a paddle, may be mounted below discharging outlet 146 for operating ice or water dispenser 144. Discharging outlet 146 and actuating mechanism 148 may be an external part of the ice dispenser 144 and may be mounted in dispenser recess 142.

In alternative exemplary embodiments, any suitable actuating mechanism may be used to operate ice dispenser 144. For example, ice dispenser 144 can include a sensor (such as an ultrasonic sensor) or a button rather than the paddle.

Figure 3:
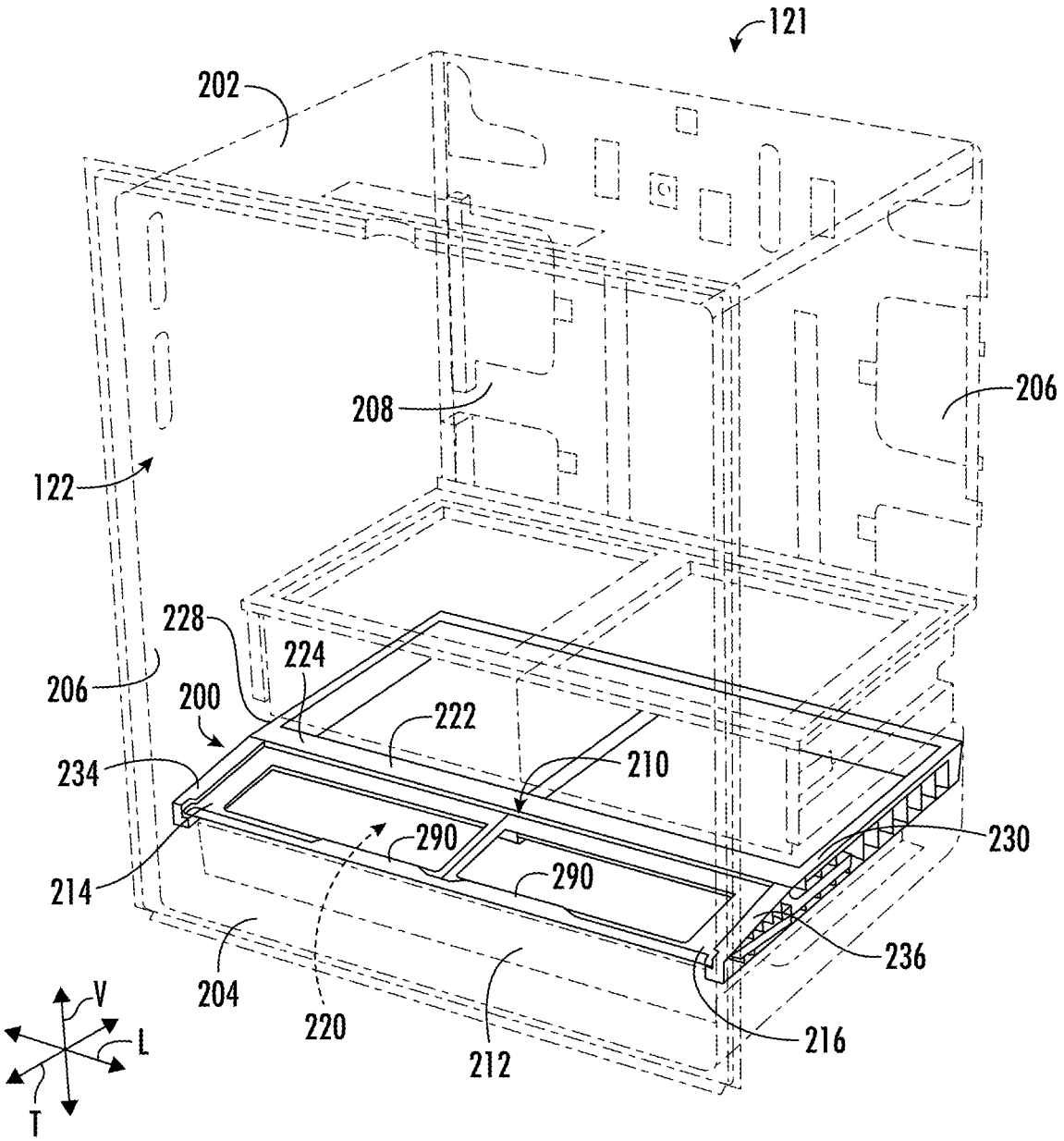
FIG. 3 provides a perspective view of a fresh food liner and a storage drawer assembly of the exemplary refrigerator appliance of FIG. 1, wherein a lid assembly of the storage drawer assembly is in a closed position.
Figure 4:
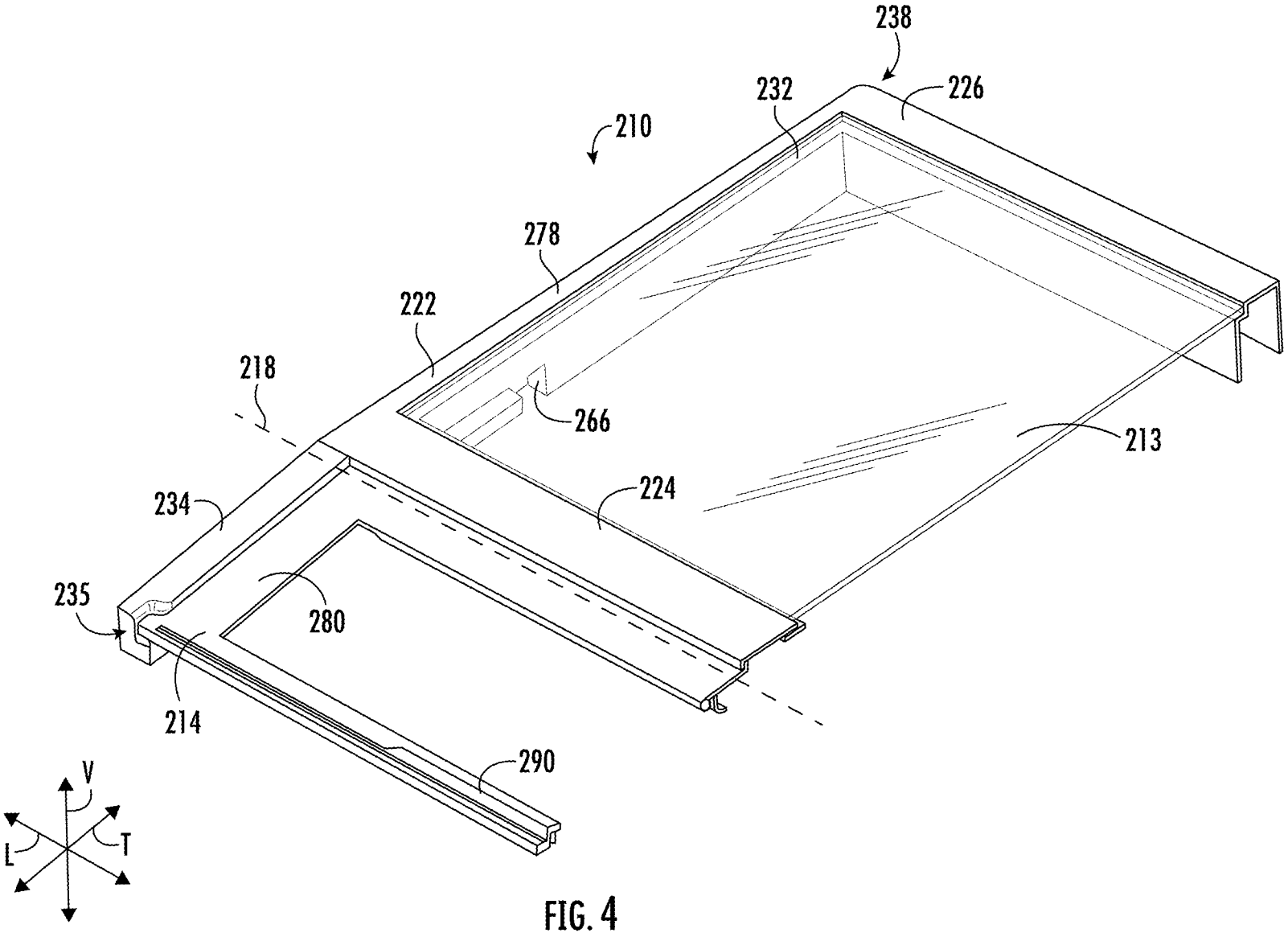
FIG. 4 provides a perspective view of a lid assembly according to one or more exemplary embodiments of the present subject matter.

By contrast, inside refrigerator appliance 100, refrigerator door 128 may define an icebox 150, see, for example, FIGS. 2 through 4, that may house an ice maker 180 and an ice storage bin 182 that may be configured to supply ice pieces to dispenser recess 142. In this regard, for example, the icebox 150 may define an ice making chamber 154 for housing an ice making assembly, a storage mechanism, and a dispensing mechanism.

A control panel 160 may be provided for controlling the mode of operation. For example, control panel 160 may include one or more selector inputs 162, such as knobs, buttons, touchscreen interfaces, for selecting a desired mode of operation, for example an ice-dispensing button that may be provided for selecting crushed or non-crushed ice pieces. In addition, the one or more selector inputs 162 may be used to specify a fill volume or method of operating dispensing assembly 140. In this regard, the one or more selector inputs 162 may be in communication with a processing device or controller 164. Signals generated in controller 164 may operate the refrigerator appliance 100 and the dispensing assembly 140 in response to the one or more selector inputs 162. Additionally, a display 166, such as an indicator light or a screen, may be provided on control panel 160. Display 166 may be in communication with controller 164 and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible to the processing device, including instructions that can be executed by processing device. Optionally, the instructions can be software or any set of instructions or data that when executed by the processing device, cause the processing device to perform operations.

Referring now to FIG. 3, a perspective view of a fresh food liner 121 of the refrigerator appliance 100 is provided according to one or more exemplary embodiments of the present subject matter. The fresh food liner 121 a top wall 202, a bottom wall 204, a pair of sidewalls 206, and a rear wall 208 that together define the fresh food chamber 122.

Figure 14:
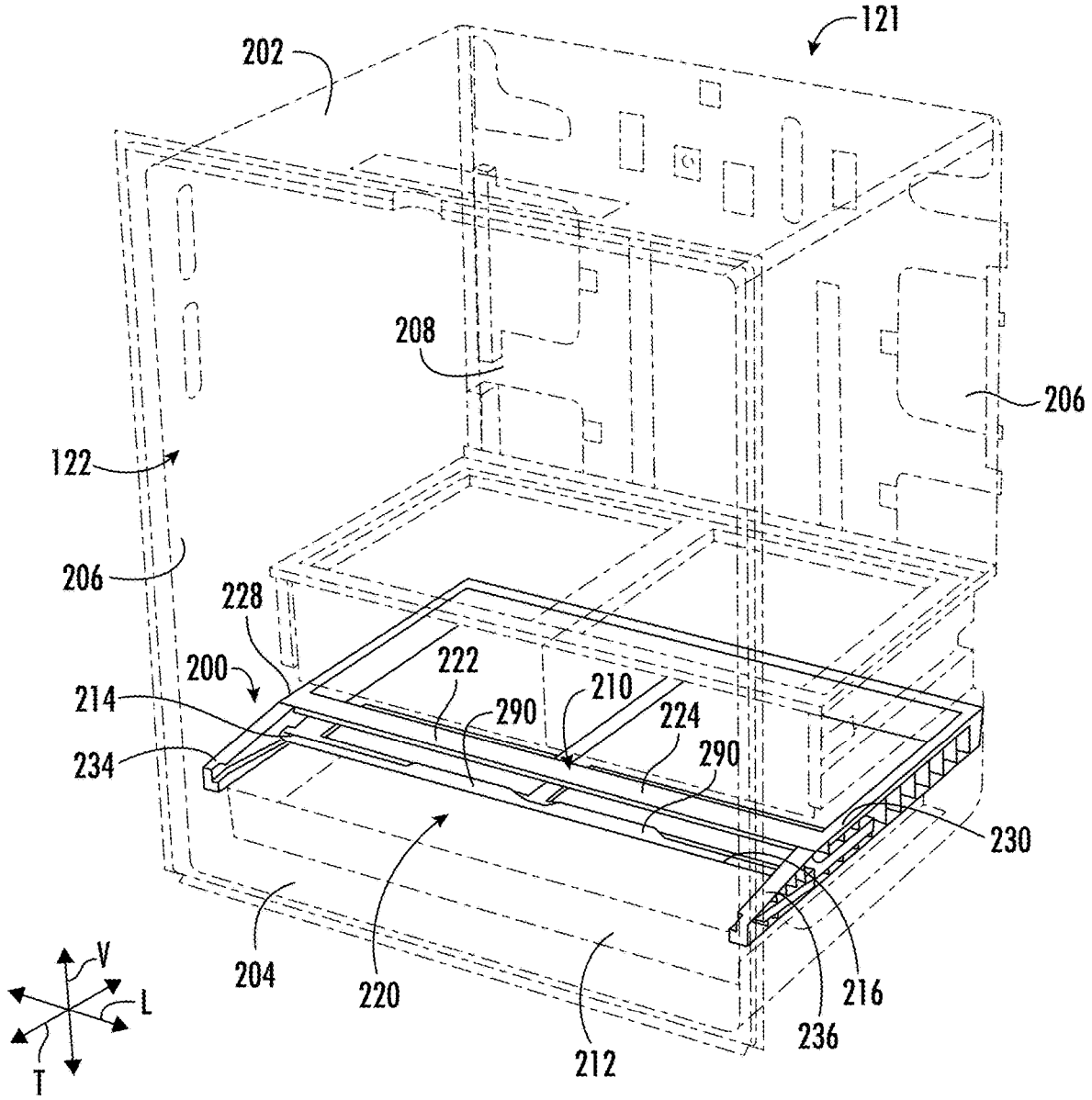
FIG. 14 provides a perspective view of a fresh food liner and a storage drawer assembly of the exemplary refrigerator appliance of FIG. 1, wherein a lid assembly of the storage drawer assembly is in a tucked position.

As briefly mentioned above, the refrigerator appliance 100 may include one or more bins or drawers 134 that define one or more storage compartments for the receipt of food items therein. Particularly, the exemplary refrigerator appliance 100 may include a storage drawer assembly 200 positioned at the bottom wall 204 of the refrigerator appliance 100, and more particularly, of the fresh food liner 121. The exemplary storage drawer assembly 200 may advantageously include a lid assembly 210 that may be, at least in part, moveable relative to a drawer 212 of the storage drawer assembly 200 between a closed position (e.g., FIG. 3), a tucked position (FIG. 14), and a flipped position (e.g., FIG. 15). Particularly, as will be described in more detail below, the lid assembly 210 of the storage drawer assembly 200 may advantageously include a split lid, e.g., a first lid 214 and a second lid 216 spaced apart along the lateral direction L. The first lid 214 and the second lid 216 advantageously be capable of sliding along the transverse direction T to permit access to the storage compartment defined by the drawer of the storage drawer assembly 200. Additionally, the first lid 214 and the second lid 216 may advantageously be capable of rotating independently, e.g., about an axis of rotation 218 defined by the lid assembly 210, to permit access to a storage compartment 220 defined by the drawer 212. Particularly, this may allow the storage compartment 220 defined by the drawer 212 to be accessed when only one of two doors 128 of the refrigerator appliance 100 is opened.

Referring still generally to FIG. 3, the drawer 212 may span, e.g., along the lateral direction L, the width of the fresh food liner 121. For instance, the drawer 212 may be spay or be extended from a first sidewall of the pair of sidewalls 206 to a second sidewall of the pair of sidewalls 206 opposite the first side wall. In this regard, the storage compartment 220 defined by the drawer 212 may span the approximate width of the fresh food liner 121. In some embodiments, the drawer 212 is slidably attached to pair of sidewalls 206 such that the drawer 212 may move between a retracted position (e.g., FIG. 3) and an extended position (not depicted along the transverse direction T. It should be appreciated that the drawer 212 may be capable of moving from the retracted position to the extended position when the doors 128 of the refrigerator appliance 100 are in the open position. For example, when the doors 128 of the refrigerator appliance 100 are in the open position, the drawer 212 may be free to slide from the retracted position to the extended position.

The lid assembly 210 may be positioned directly above the drawer 212 to selectively permit access to the storage compartment 220 defined by the drawer 212. The lid assembly 210 may generally include a cover 222, the first lid 214, and the second lid 216. The first lid 214 and the second lid 216 may be moveably mated to the cover 222. In some embodiments, the first lid 214 and the second lid 216 are together moveable relative to the cover 222 between a fully closed position (e.g., FIG. 3) and a tucked position (e.g., FIG. 14).

As used herein the "fully closed position" of the lid assembly 210 may generally correspond to a position of the lid assembly 210 wherein the first lid 214 and the second lid 216 together block or inhibit access to the storage compartment 220 defined by the drawer 212. In the fully closed position of the lid assembly 210 the first lid 214 and the second lid 216 may be translated to a forward most position within respective guides (e.g., described in more detail below) defined by the cover 222. In some embodiments, in the fully closed position of the lid assembly 210, a front end of the lid assembly 210 is positioned at or in front of (e.g., along the transverse direction T), a front end of the drawer 212.

As used herein the "tucked position" may generally correspond to a position of the lid assembly 210 wherein the first lid 214 and the second lid 216 permit access to the full width of the storage compartment 220. In the tucked position of the lid assembly 210, the first lid and the second lid may be translated to a rearward most position within guides defined by the cover 222. Particularly, to move the lid assembly 210 from the fully closed position to the tucked position, the first lid 214 and the second lid 216 may translate together (e.g., along the transverse direction T) toward the rear wall 208 of the fresh food liner 121. In some embodiments, in the tucked position, the first lid 214 and the second lid 216 may be positioned within the storage compartment 220.

In some other embodiments, the lid assembly 210 may be moveable between a first flipped position and a second flipped position. As used herein the "first flipped position" may correspond to a position of the lid assembly 210 wherein the first lid 214 is rotated about the axis of rotation 218 and the second lid 216 is in the closed position. Particularly, the first lid 214 may be independently rotatable relative to the second lid 216. For instance, the first lid 214 may be capable of rotation (e.g., about the axis of rotation 218) independent of the second lid 216. In the first flipped position, access to a first predetermined lateral width of the storage compartment 220 may be permitted (e.g., to a user). The first predetermined lateral width of the storage compartment 220 may correspond to the area underneath (e.g., directly or indirectly) the first lid 214. In some embodiments, the first predetermined lateral width of the storage compartment 220 is less than the full lateral width of the storage compartment 220. For example, the first predetermined lateral width may be half of the lateral width of the storage compartment 220. As another example, the first predetermined lateral width may be two thirds of the lateral width of the storage compartment 220. As yet another example, the first predetermined lateral width may be one third of the lateral width of the storage compartment 220.

Figure 15:
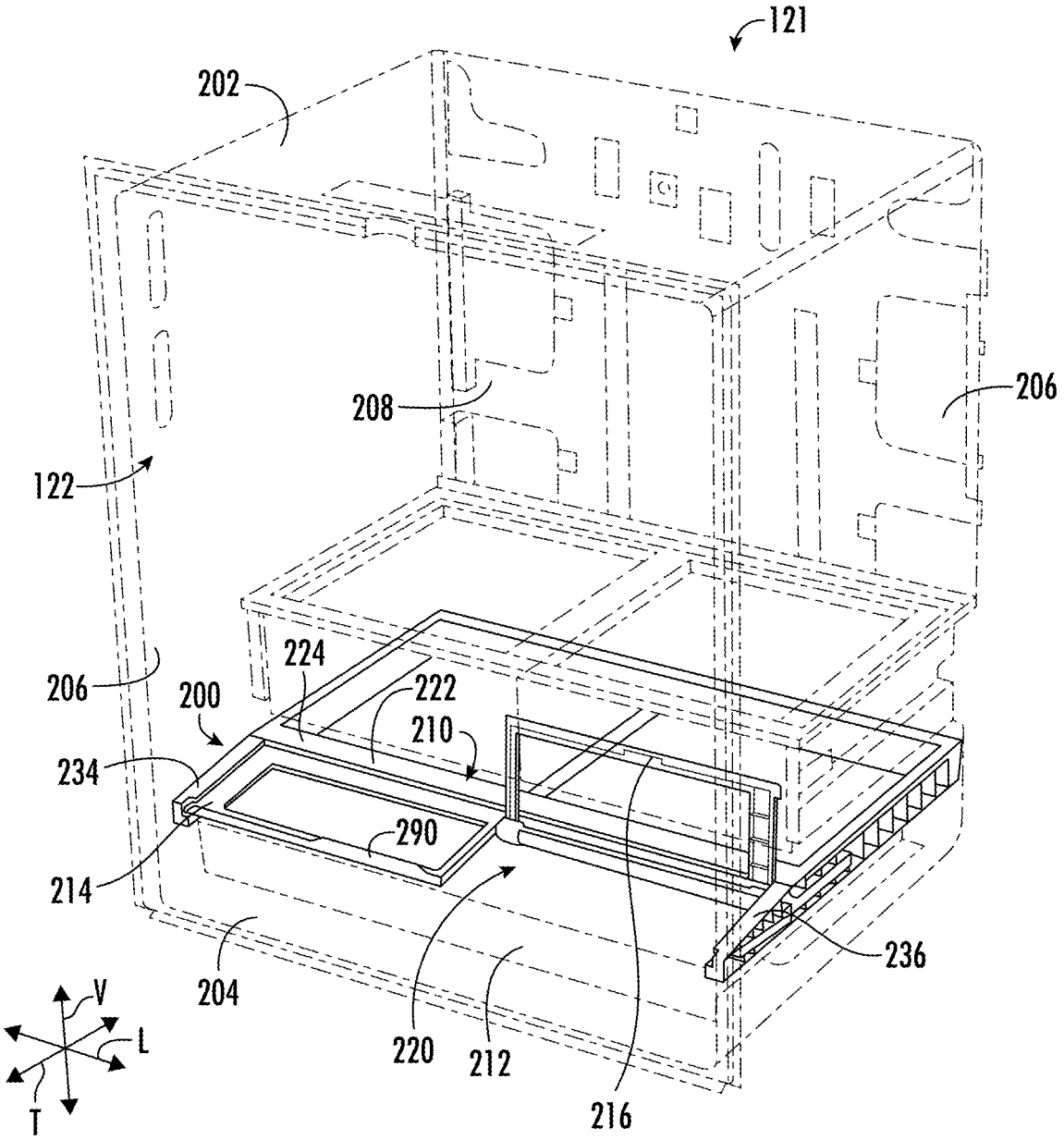
FIG. 15 provides a perspective view of a fresh food liner and a storage drawer assembly of the exemplary refrigerator appliance of FIG. 1, wherein a lid assembly of the storage drawer assembly is in a flipped position.

Further, as used herein the "second flipped position" may correspond to a position of the lid assembly 210 wherein the second lid 216 is rotated about the axis of rotation 218 and the first lid 214 is in the closed position (e.g., the first lid 214 has not rotated upward, see e.g., FIG. 15). Particularly, the second lid 216 may be independently rotatable relative to the first lid 214. For instance, the second lid 216 may be capable of rotation (e.g., about the axis of rotation 218) independent of the first lid 214. In the second flipped position, access to a second predetermined lateral width of the storage compartment 220 may be permitted (e.g., to a user). The second predetermined lateral width of the storage compartment 220 may correspond to the area underneath (e.g., directly or indirectly) the second lid 216. In some embodiments, the second predetermined lateral width of the storage compartment 220 is less than the full lateral width of the storage compartment 220. For example, the second predetermined lateral width may be half of the lateral width of the storage compartment 220. As another example, the second predetermined lateral width may be two thirds of the lateral width of the storage compartment 220. As yet another example, the second predetermined lateral width may be one third of the lateral width of the storage compartment 220. Moreover, in some embodiments, the second predetermined lateral width of the storage compartment 220 may overlap with the first predetermined lateral width of the storage compartment 220.

Referring now to FIG. 4, a perspective view of a portion of the lid assembly 210 is provided. The cover 222 may include a structural frame that defines the shape of a top shelf 223 of the lid assembly 210. In some embodiments, the top shelf 223 is constructed from a transparent material such as glass, acrylic, plexiglass. In some embodiments, the structural frame comprises a front member 224, a rear member 226, a first side member 228, and a second side member 230. Each of the front member 224, the rear member 226, the first side member 228, and the second side member 230 may include a ledge 232, that may hold the top shelf 223 thereon.

Figure 5:
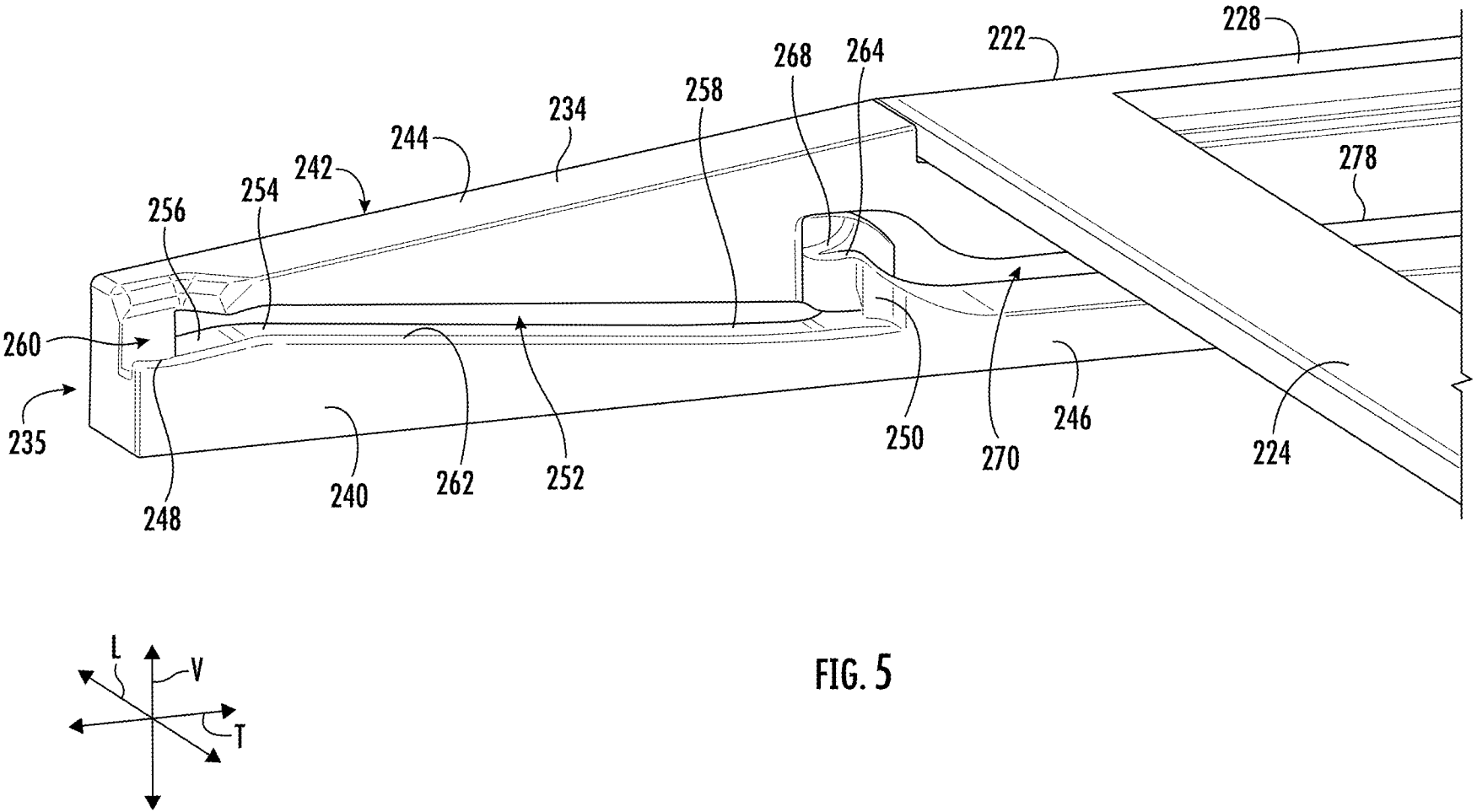
FIG. 5 provides a perspective view of a side support of a lid assembly according to one or more exemplary embodiments of the present subject matter.
Figure 6:
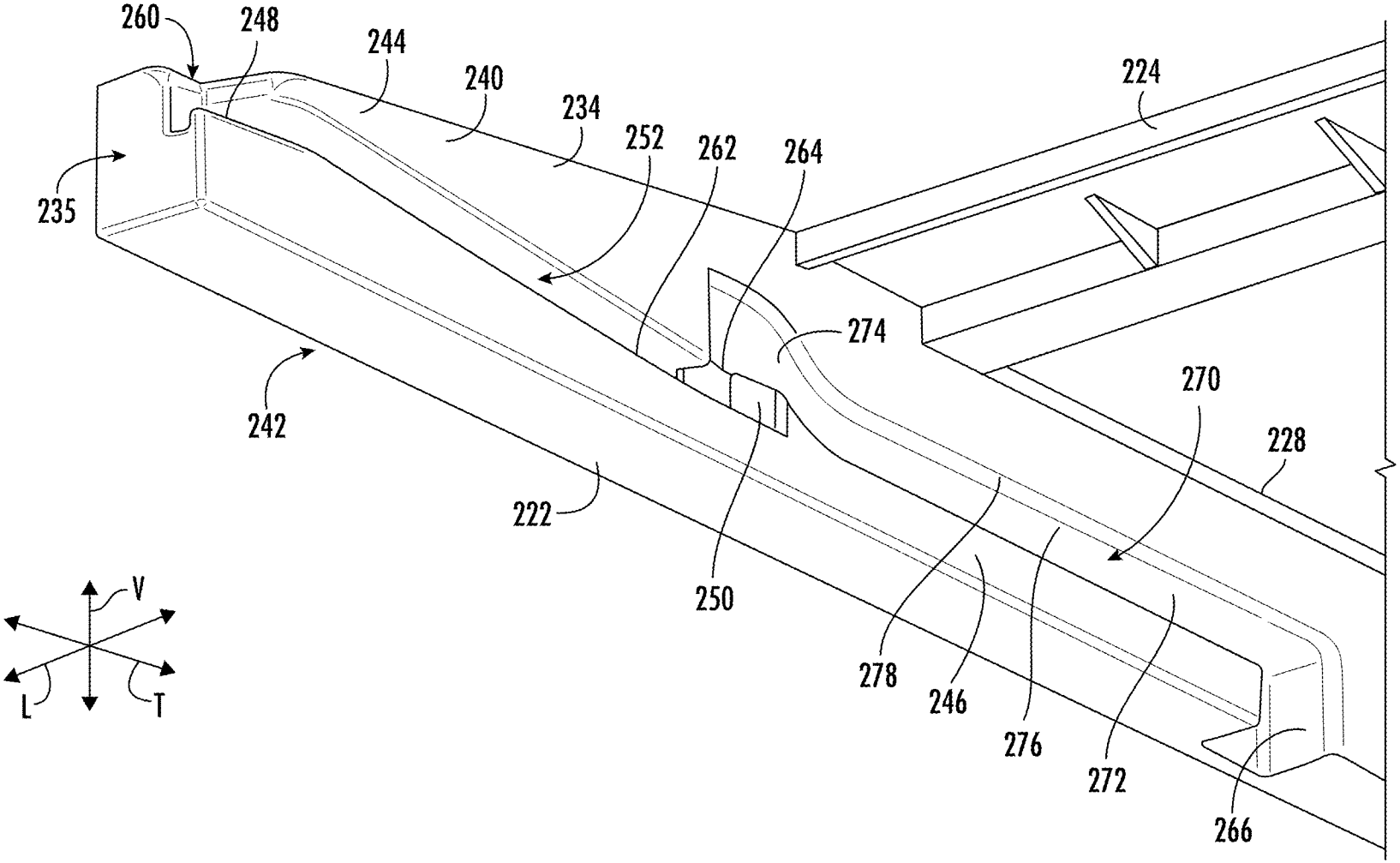
FIG. 6 provides a perspective view of a side support of a lid assembly according to one or more exemplary embodiments of the present subject matter.

In some embodiments, the cover 222 of the lid assembly 210 includes a pair of side supports (e.g., a first side support 234 and a second side support 236) positioned at opposing sides (e.g., along the lateral direction L) of the lid assembly 210. For example, referring now to FIGS. 5 and 6, a perspective view of the first side support 234 is provided. As should be appreciated only the first side support 234 is described in detail herein for brevity and clarity purposes only. One of ordinary skill in the art would recognize that the structure, function, or configuration of the second side support 236 may be identical to, or may mirror that of, the first side support 234 described herein.

The first side support 234 may extend between a front end 235 and a rear end 238 (e.g., FIG. 4) along the transverse direction T. The first side support 234 may include an inner side 240 and an outer side 242 spaced apart along the lateral direction L. The outer side 242 may be positioned adjacent to or may be interfaced with the first sidewall 206 of the fresh food liner 121. The first side support 234 may include a front guide 244 and a rear guide 246 for receiving the first lid 214 (e.g., described in more detail below). The front guide 244 may be positioned in front of the rear guide 246 (e.g., along the transverse direction T). The front guide 244 may extend (e.g., along the transverse direction T) between a front start 248 and a front stop 250. The front start 248 may be positioned at, or proximate to, the front end 235 of the first side support 234. In some embodiments, the front start 248 may correspond to a relatively flat portion at the front end 235 of the first side support 234 that the front follower 248 may rest at or on in a closed position (e.g., the fully closed position, the first closed position, or the second closed position). In some embodiments, the front start 248 may be positioned below a rotation opening 260 (described in more detail below) to permit rotation of the first lid 214 between the closed position and the first flipped position.

In some embodiments, the front stop 250 is positioned in front of (e.g., along the transverse direction T) the front member 224 of the cover 222. The front stop 250 may correspond to an end portion of the front guide 244. In some embodiments, the front stop 250 defines the end of the range of motion (e.g., along the transverse direction T) of the first lid 214. For instance, as the first lid 214 is translated to the fully closed position, the front stop 250 may stop translation of the first lid 214 as the front follower contacts the front stop 250.

Further, the front guide 244 may define a front slot 252 through the inner side 240 and the outer side 242. The front slot 252 may receive a front follower 294 (e.g., described in more detail below) of the first lid 214. The front guide 244 may also include a front locating rail 254. The front locating rail 254 may extend from the front start 248 to the front stop 250. In some embodiments, the front locating rail 254 may face upward, e.g., along the vertical direction V. In this regard, the front follower 294 may sit on top of the front locating rail 254.

In some embodiments, the shape of the front locating rail 254 may facilitate smooth translation or movement of the first lid 214 between the closed position and the tucked position. For instance, the front locating rail 254 may include a front flat portion 256 and a front sloped portion 258. In some embodiments, the front flat portion 256 is positioned in front of the front sloped portion 258, e.g., along the transverse direction T. For instance, the front flat portion 256 may be positioned, at or proximate to, the front start 248 of the front locating rail 254. The front sloped portion 258 may define a relatively constant downward slope from the front flat portion 256 to the front stop 250 of the of the front guide 244. In addition, the front guide 244 may define a rotation opening 260 above, e.g., along the vertical direction V, the front flat portion 256. The rotation opening 260 may permit the front follower 294 to pass therethrough when the first lid 214 is rotated between the closed position and the flipped position. The front guide 244 may also include a front lip 262 extending upward (e.g., along the vertical direction V) from the front locating rail 254. Particularly, the front lip 262 may be positioned at the inner side 240 of the first side support 234.

The rear guide 246 may be positioned behind the front guide 244 (e.g., along the transverse direction T). The rear guide 246 may extend (e.g., along the transverse direction T) between a rear start 264 and a rear stop 266 (e.g., FIG. 6). The rear start 264 may be positioned at or proximate to the front stop 250 of the front guide 244. Particularly, the rear start 264 may be positioned above (e.g., directly above along the vertical direction V) the front stop 250. In some embodiments, the rear guide 246 includes a blocking element 268 at the rear start 264. The blocking element 268 may include an arc shape protrusion that may receive a locking element 302 of a rear follower 296 (e.g., described in more detail below).

Further, the rear guide 246 may define a rear slot 270 through the inner side 240 and the outer side 242 of the first side support 234. The rear slot 270 may receive a rear follower 296 (e.g., described in more detail below) of the first lid 214. The rear guide 246 may also include a rear locating rail 272. The rear locating rail 272 may extend from the rear start 264 to the rear stop 266. In some embodiments, the shape of the rear locating rail 272 may facilitate smooth translation or movement of the first lid 214 between the closed position and the tucked position. The rear locating rail 272 may include a rear sloped portion 274 and a rear flat portion 276. The rear sloped portion 274 may be positioned in front of the rear flat portion 276 (e.g., along the transverse direction T). The rear sloped portion 274 may define a downward slope from the blocking element 268 to a start of the rear flat portion 276. In addition, the rear guide 246 may include a rear lip 278 extending downward (e.g., along the vertical direction) from the rear locating rail 272. Particularly, the rear lip 278 may be positioned at the inner side 240 of the first side support 234.

Figure 7:
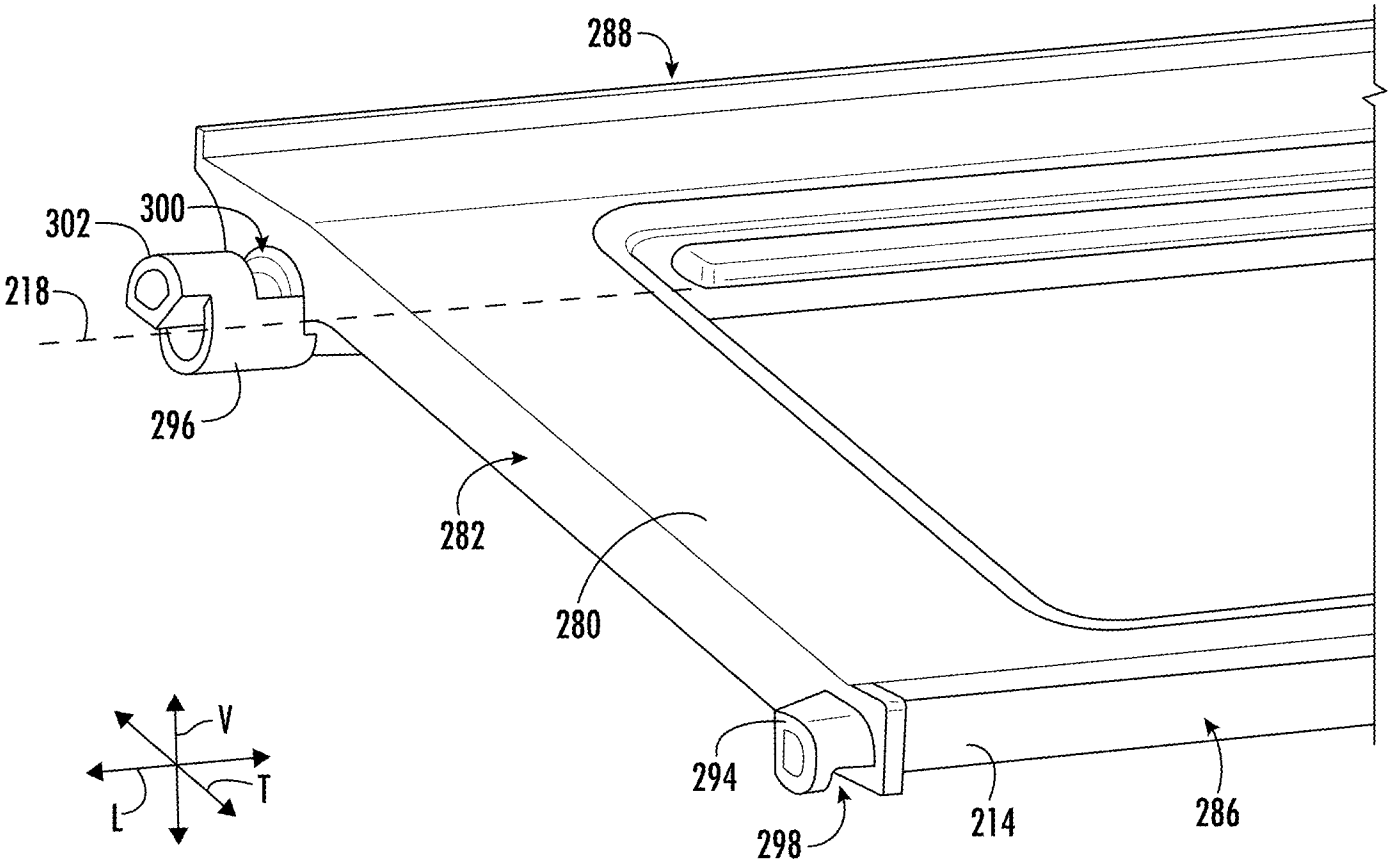
FIG. 7 provides a perspective view of a lid of a lid assembly according to one or more exemplary embodiments of the present subject matter.

Referring now to FIG. 7, a perspective view of a portion of the first lid 214 of the lid assembly 210 is provided. As should be appreciated only the first lid 214 is described in detail herein with reference to FIG. 7 for brevity and clarity purposes only. One of ordinary skill in the art would recognize that the structure, function, or configuration of the second lid 216 may be identical (e.g., completely identical or nearly identical) or may mirror that of the first lid 214 described herein. Accordingly, the same or similar reference numbers used to identify components of the first lid 214 may be used to identify the same or similar components of the second lid 216.

The first lid 214 may include a main body 280. The main body 280 may extend between a first side 282 and a second side 284 (e.g., along the lateral direction L). In addition, the main body 280 may extend between a front end 286 and a rear end 288 (e.g., along the transverse direction T). In some embodiments, the main body 280 includes a handle 290 at the front end 286. The handle 290 may extend upward (e.g., along the vertical direction V) to provide a contact point for a user of the refrigerator appliance 100. Particularly, the user may hold or grab the handle 290 to transition the first lid 214 between the closed position, the tucked position, or the flipped position.

In some embodiments, the main body 280 includes a transparent panel 292 for viewing the storage compartment 220 of the drawer 212 (e.g., when the lid assembly 210 is in the closed position). The transparent panel 292 may be formed of any suitable material that may allow light to pass through or that may allow viewing of the storage compartment 220 when the lid assembly 210 is in the closed position. For example, the transparent panel 292 may be formed from glass, acrylic, plexiglass, etc.

The first lid 214 may include a front follower 294 and a rear follower 296. The front follower 294 may be extended from the first side 282 of the main body 280 at, or proximate to, the front end 286 of the main body 280. In some embodiments, the front follower 294 may define a front notch 298 at a bottom thereof. The front notch 298 may locate the front follower 294 to the front locating rail 254, and more particularly, the front lip 262 of the front guide 244. The rear follower 296 may be extended from the first side 282 of the main body 280 at, or proximate to, the rear end 288 of the main body 280. In some embodiments, the rear follower 296 may define a rear notch 300 at a top thereof. The rear notch 300 may locate the rear follower 296 to the rear locating rail 272, and more particularly, the rear lip 278 of the rear guide 246. In addition, in some embodiments, the rear follower 296 may include a locking element 302 extended outward (e.g., along the lateral direction L). The locking element 302 may selectively permit translation (e.g., along the transverse direction T) of the first lid 214 between the closed position and the tucked position.

Figure 8:
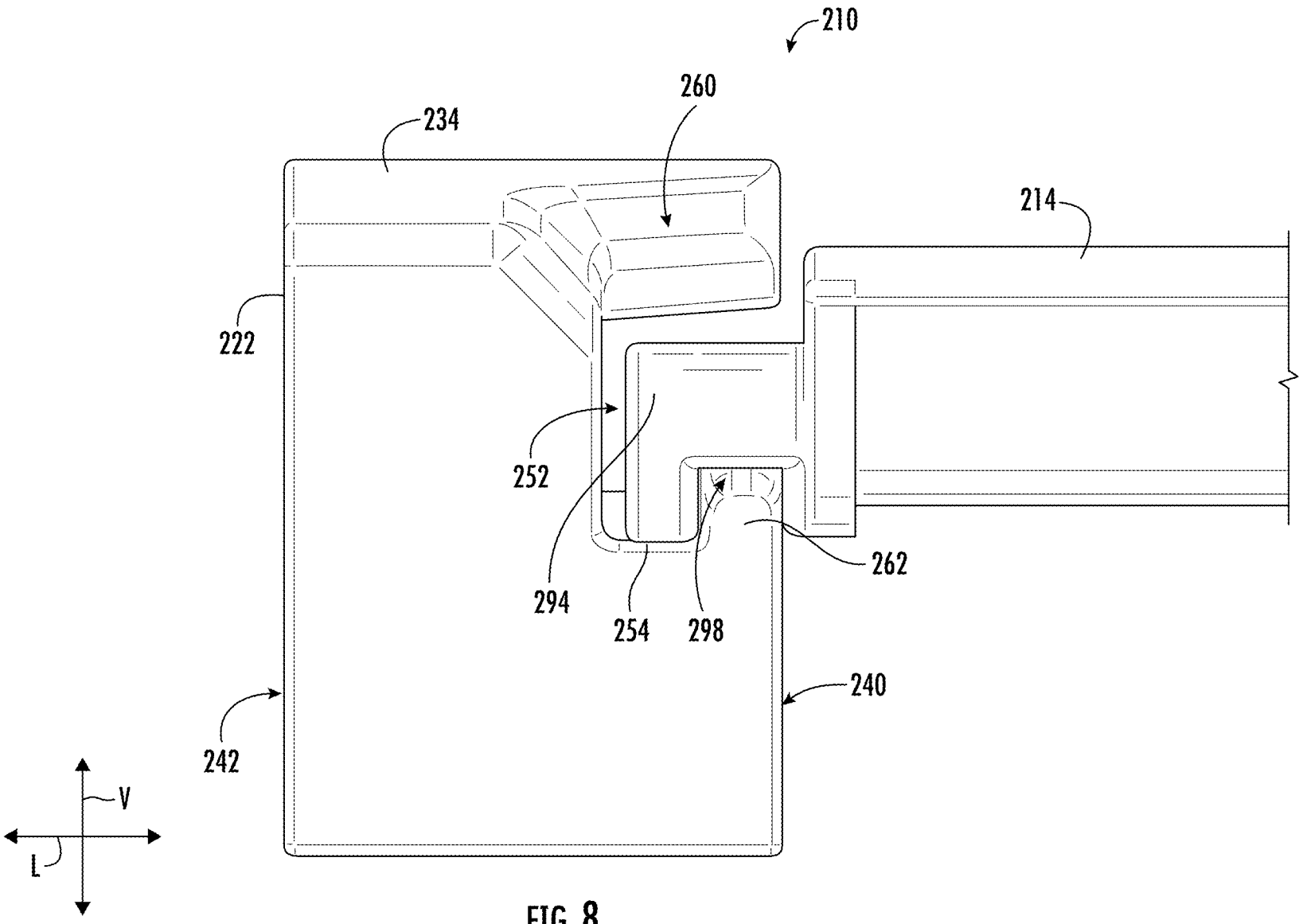
FIG. 8 provides an elevation view of a lid assembly according to one or more exemplary embodiments of the present subject matter.

In some embodiments, the front follower 294 is received within the front slot 252 defined by the front guide 244. For example, referring now to FIG. 8, an elevation view of the first side support 234 and the first lid 214 in the closed position is provided. In the closed position, the front follower 294 may be moveably mated to the front locating rail 254 of the front guide 244. In other words, the front follower 294 may be capable of translating or "moving" along the front locating rail 254 from the front start 248 to the front stop 250. For instance, when the first lid 214 is transitioned between the closed position and the tucked position, the front follower 294 may slide along the front locating rail 254. Additionally or alternatively, when the first lid 214 is transitioned between the closed position and the flipped position, the front follower 294 may be capable of passing through the rotation opening 260 defined by the front guide 244.

Figure 9:
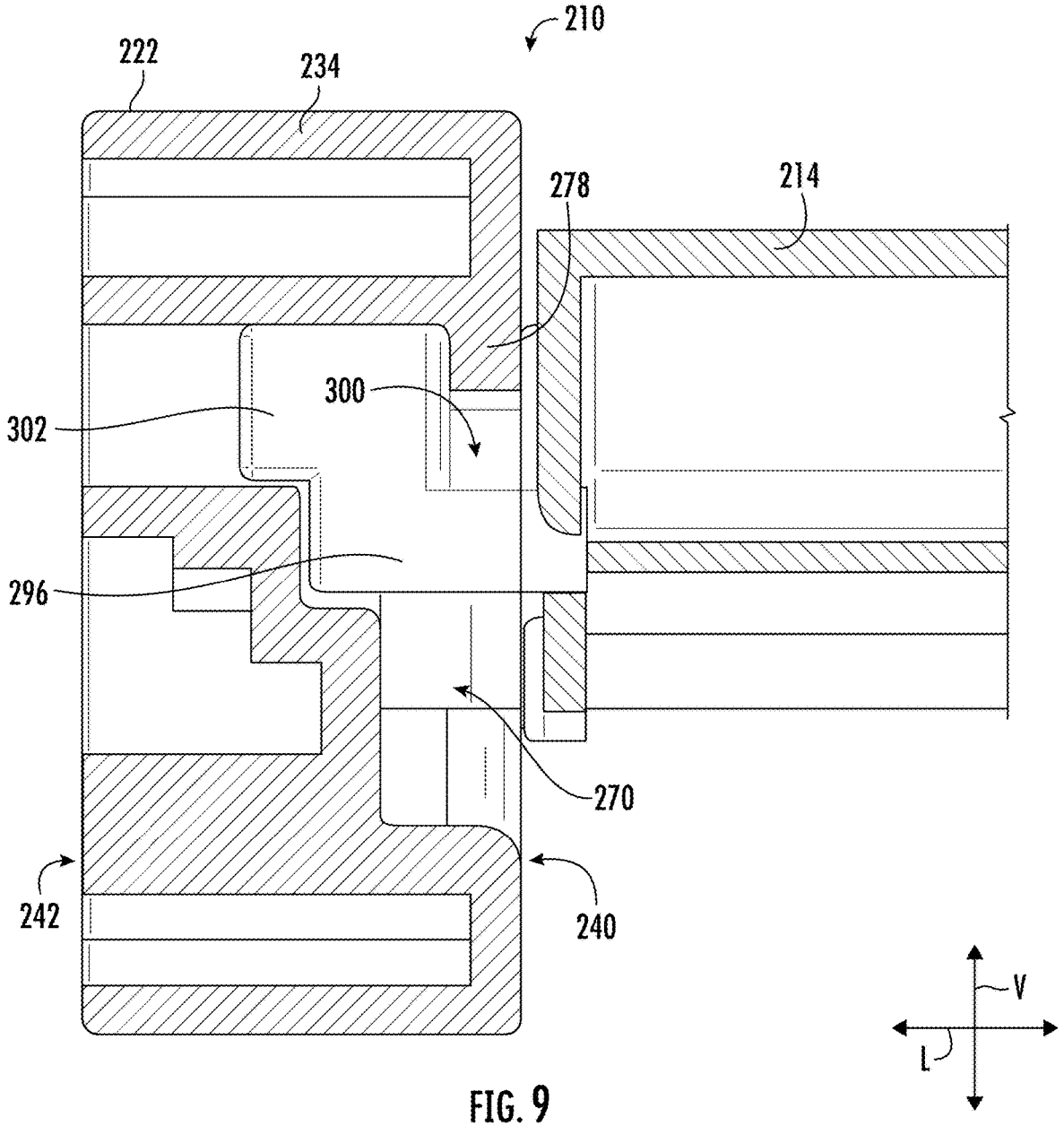
FIG. 9 provides a cross-sectional view of a lid assembly according to one or more exemplary embodiments of the present subject matter.

In some embodiments, the rear follower 296 is received within the rear slot 270 defined by the rear guide 246. For example, referring now to FIG. 9, a cross-sectional view of the first side support 234 and the first lid 214 in the closed position is provided. In the closed position, the rear follower 296 may be moveably mated to the rear locating rail 272 of the rear guide 246. In other words, the rear follower 296 may be capable of translating or "moving" along the rear locating rail 272 from the rear start 264 to the rear stop 266. For instance, when the first lid 214 is transitioned between the closed position and the tucked position, the rear follower 296 may translate along the rear locating rail 272. Additionally or alternatively, when the first lid 214 is transitioned between the closed position and the flipped position, the rear follower 296 may be capable of rotating within the rear slot 270 at the rear start 264.

Figure 10:
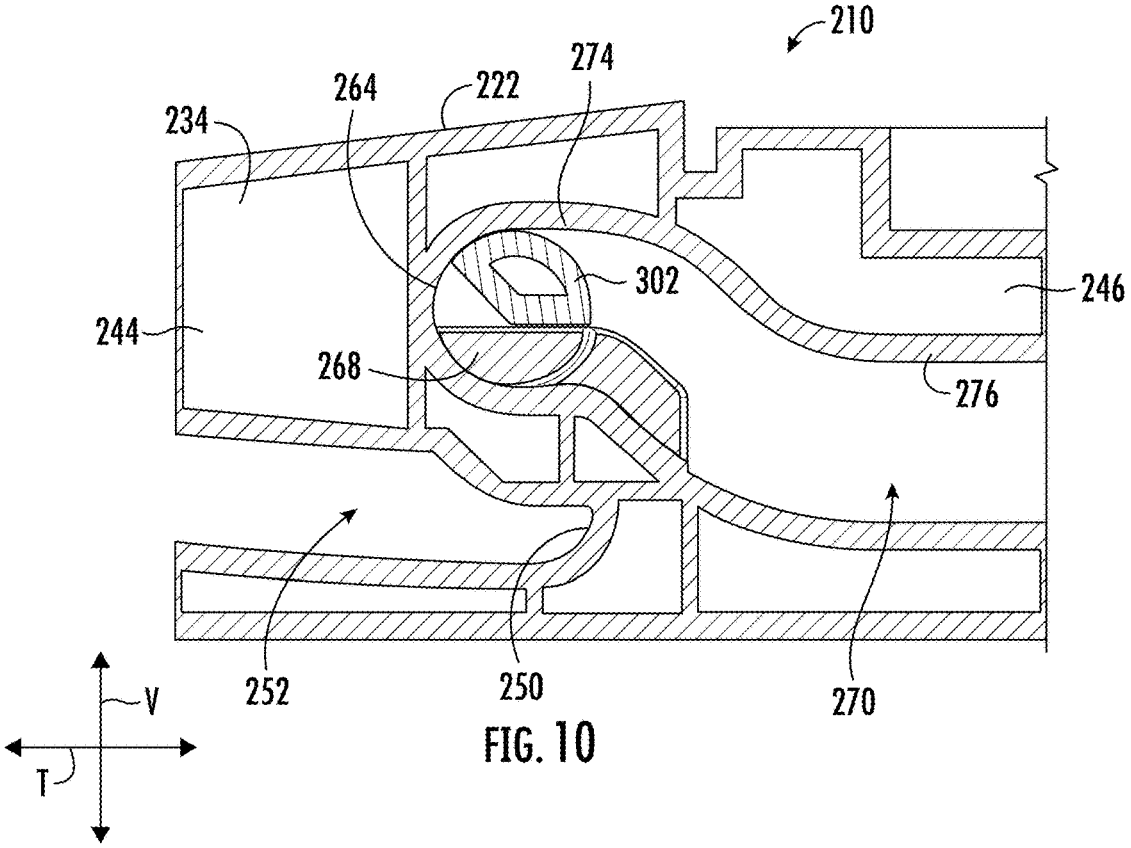
FIG. 10 provides a cross-sectional view of a side support and a locking element of a lid assembly according to one or more exemplary embodiments of the present subject matter.
Figure 11:
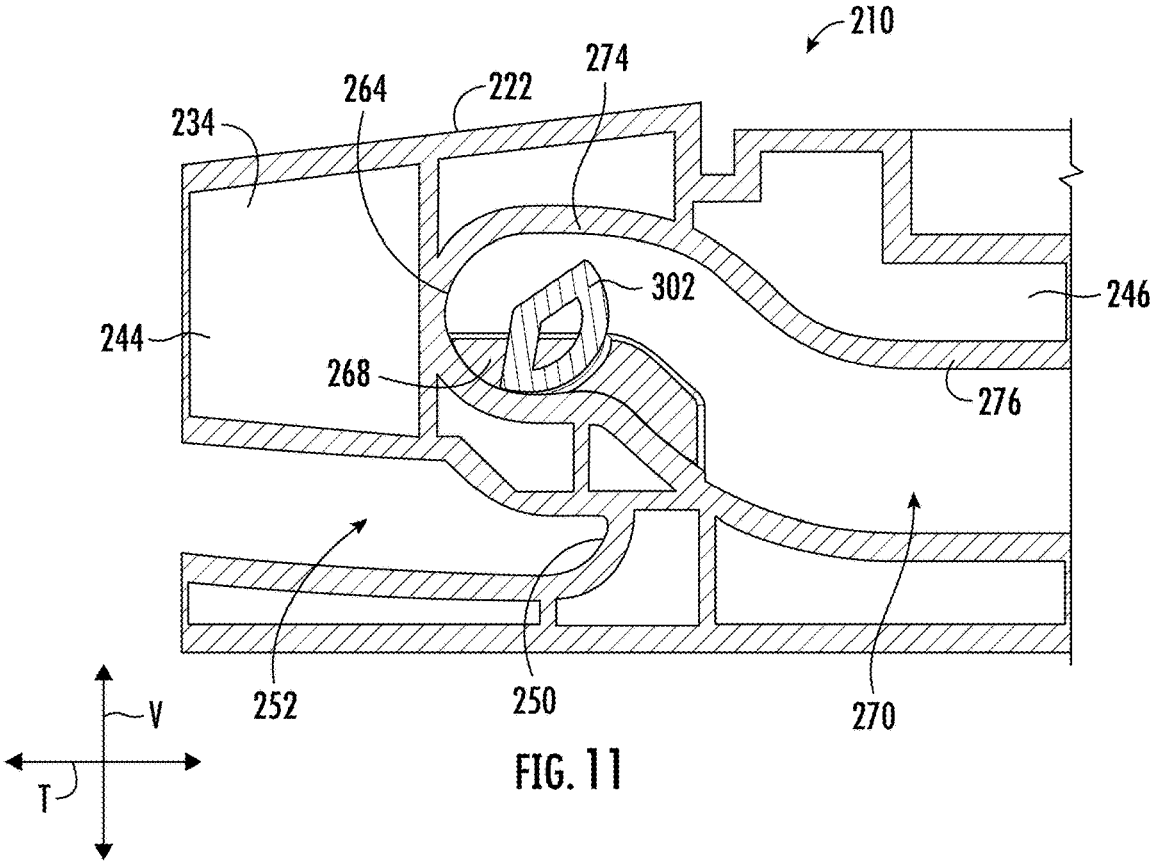
FIG. 11 provides a cross-sectional view of a side support and a locking element of a lid assembly according to one or more exemplary embodiments of the present subject matter.

Referring now to FIGS. 10 and 11, cross-sectional views of the first side support 234 and the locking element 302 of the rear follower 296 are provided. The locking element 302 may selectively interact with the blocking element 268 of the rear guide 246 to selectively block or inhibit the first lid 214 from moving from the closed position to the tucked position. Specifically, the locking element 302 may be rotatable within the blocking element 268 between a free position and a blocked position. In the free position, the first lid 214 may be capable of translating between the closed position and the tucked position. In the blocked position, the first lid 214 may be incapable of transitioning between the closed positioned and the tucked position.

Particularly, when the first lid 214 is rotated to the flipped position, the locking element 302 may move to the blocked position and engage with blocking element 268 at the rear start 264. In this position, the blocking element 268 may block are inhibit translation or movement (e.g., along the transverse direction T) of the first lid 214. Conversely, when the first lid 214 is in the closed position, the locking element 302 may be clear from the blocking element 268. For instance, the locking element 302 may be in the free position and positioned above the blocking element 268. In this regard, the blocking element 268 may not block the locking element 302 and translation or movement of the first lid 214 may be permitted.

Figure 12:
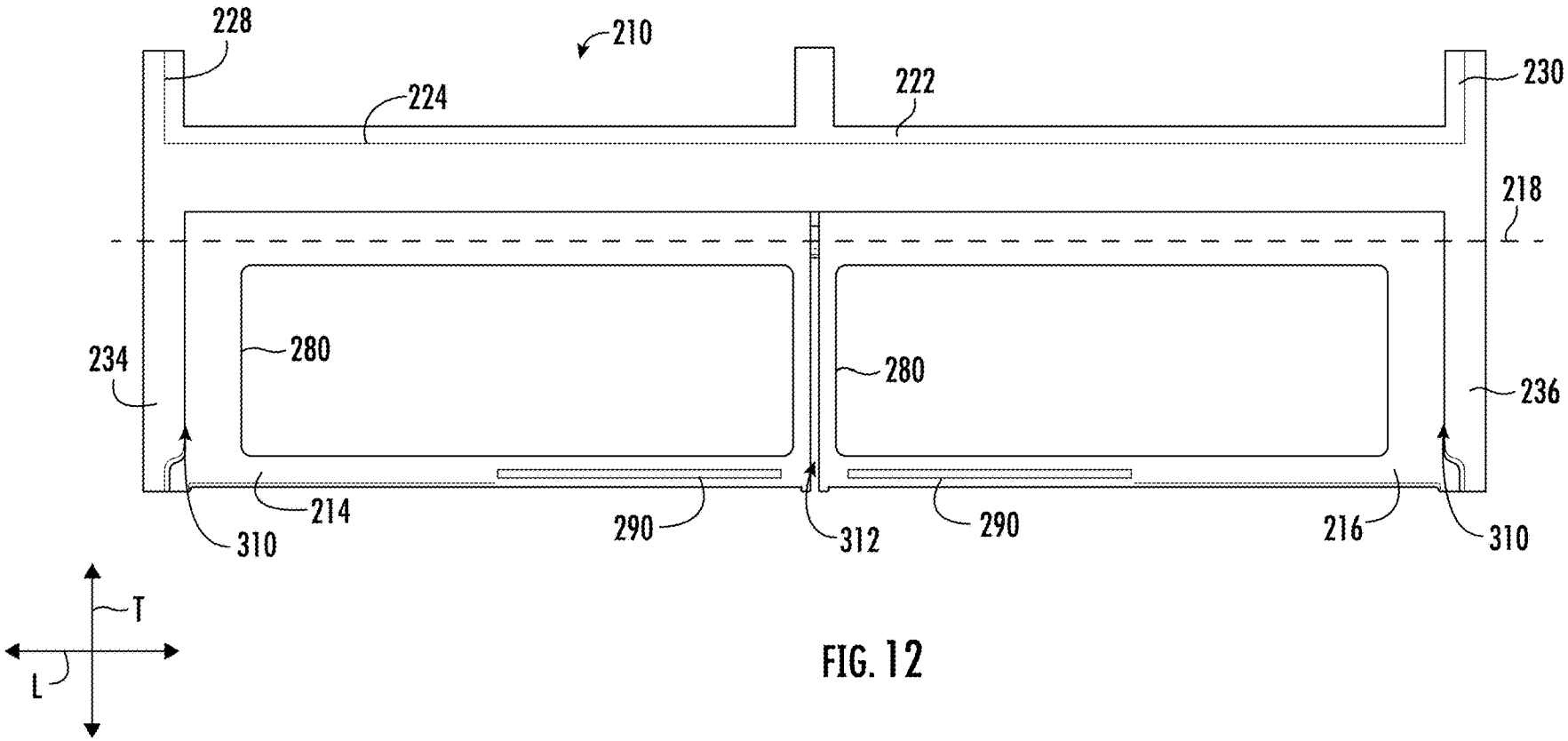
FIG. 12 provides an elevation view of a storage drawer assembly according to one or more exemplary embodiments of the present subject matter.

Referring now to FIG. 12, an elevation view of the lid assembly 210 according to one or more embodiments is provided. The notches (e.g., the front notch 298 or the rear notch 300) of the lid followers (e.g., the front follower 294 or the rear follower 296) may tightly engage or fit around the front lips 262 and the rear lips 278 of the cover 222 to constrain the size of a gap 310 between the first lid 214 and the first side support 234 or the second lid 216 and the second side support 236. Particularly, the engagement or fit of the notches around the lid followers may constrain movement (e.g., movement along the lateral direction L) of the first lid 214 or the second lid 216. In this regard, the gaps 310 between the first lid 214 and the first side support 234 or the second lid 216 and the second side support 236 may generally be referred to as "constrained gaps 310." These constrained gaps 310 may advantageously allow a gap 312 between the first lid 214 and the second lid 216 to be unconstrained. For instance, the gap 312 between the first lid 214 and the second lid 216 may be unconstrained such that dimensional over constraint of the lid assembly 210 (e.g., during manufacturing) can be prevented or avoided. In other words, the gap 312 between the first lid 214 and the second lid 216 may notably absorb dimensional errors that may occur during manufacturing of the lid assembly 210.

Figure 13:
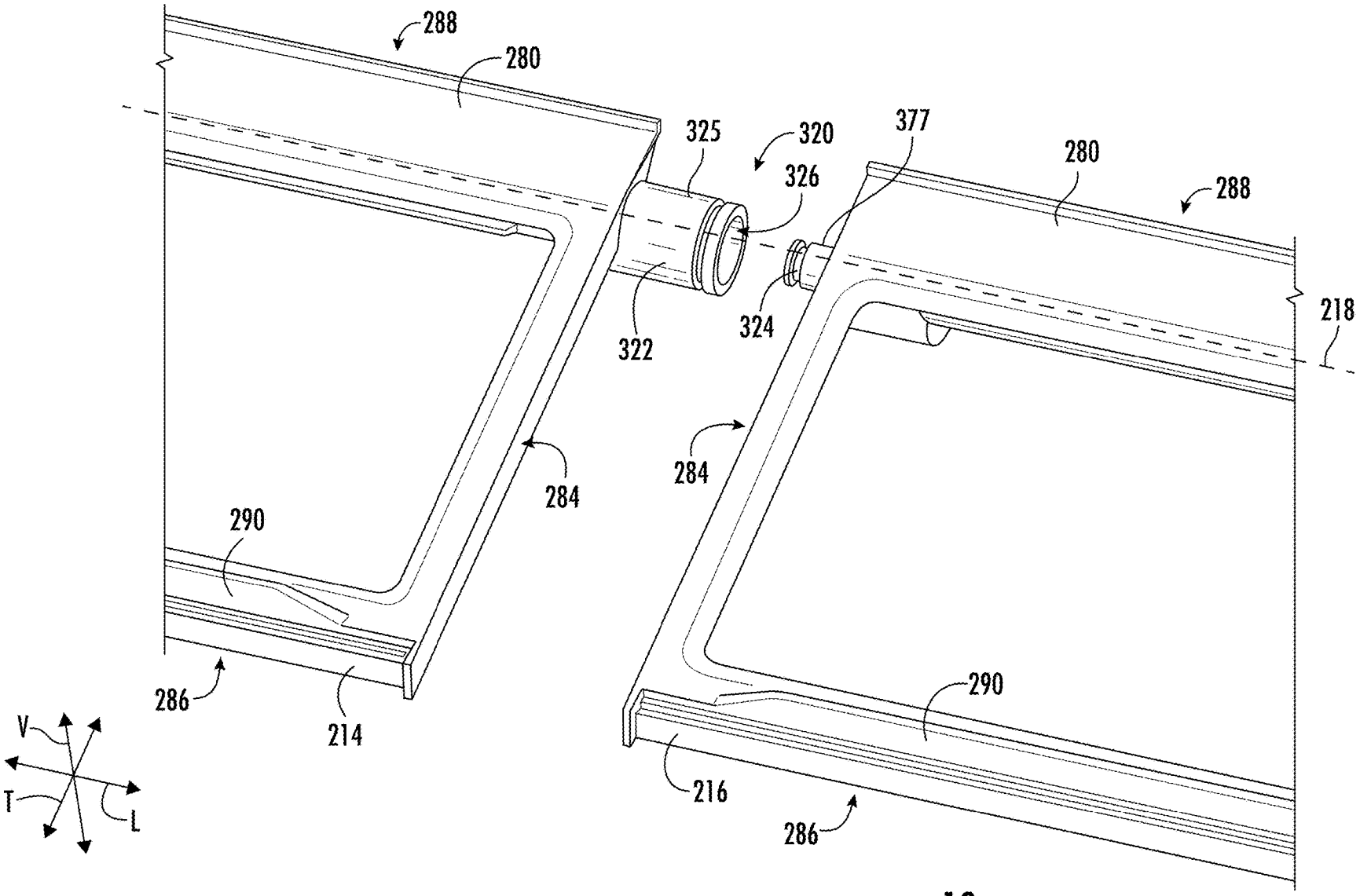
FIG. 13 provides an exploded view of a lid assembly according to one or more exemplary embodiments of the present subject matter.

Referring now to FIG. 13, an exploded view of the first lid 214 and second lid 216 are provided. In some embodiments, the lid assembly 210 may include a rotational damper 320 positioned between the first lid 214 and the second lid 216. The rotational damper 320 may be in line with the axis of rotation 218. The rotational damper 320 may include a first damper element 322 and a second damper element 324. The first damper element 322 of the rotational damper 320 element may be extended from the second side 284 of first lid 214 or the second lid 216 along the axis of rotation 218. The second damper element 324 may be extended from the second side 284 of the other of the first lid 214 or the second lid 216 along the axis of rotation 218. The first damper element 322 and the second damper element 324 may be rotatably mated or coupled to one another to permit individual rotation of the first lid 214 or the second lid 216.

The rotational damper 320 may be provided as any suitable joint that may allow individual rotation of the first lid 214 or the second lid 216. For example, as illustrated in FIG. 13, the first damper element 322 be extended from the second side 284 of the first lid 214 and may include a barrel 325 defining an opening 326. The second damper element 324 be extended from the second side 284 of the second lid 216 and may include a pin 327 rotatably coupled or mated within the opening 326 of the barrel 325.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a cabinet defining a chilled chamber; and a storage drawer assembly positioned within the chilled chamber, the storage drawer assembly defining a first side and a second side spaced apart along the lateral direction, the storage drawer assembly comprising:

a drawer positioned within the cabinet, the drawer defining a storage compartment; and a lid assembly positioned above the drawer, the lid assembly comprising:

a cover comprising a first side support and a second side support spaced apart along the lateral direction;

a first lid moveably mated to the first side support; and a second lid moveably mated to the second side support, the first lid and the second lid together defining an axis of rotation positioned proximate a rear end of the lid assembly, the axis of rotation extending parallel to the lateral direction; and a rotational damper between the first lid and the second lid, wherein the rotational damper is positioned in line with the axis of rotation, wherein the first lid and the second lid are together moveable relative to the first side support and the second side support between a fully closed position and a tucked position, wherein the first lid is rotatable about the axis of rotation independent of the second lid between a first closed position and a first flipped position, and wherein the second lid is rotatable about the axis of rotation independent of the first lid between a second closed position and a second flipped position.

2. The refrigerator appliance of claim 1, wherein the first side support comprises a first front guide and a first rear guide, wherein the first front guide defines a first rotation opening at a front thereof for permitting rotation of the first lid between the first closed position and the first flipped position, wherein the first front guide is positioned in front of the first rear guide along the transverse direction, wherein the first lid is moveably mated to the first front guide and the first rear guide, wherein the second side support comprises a second front guide and a second rear guide, wherein the second front guide defines a second rotation opening for permitting rotation of the second lid between the second closed position and the second flipped position, wherein the second front guide is positioned in front of the second rear guide along the transverse direction, wherein the second lid is moveably mated to the second front guide and the second rear guide.

3. The refrigerator appliance of claim 2, wherein the first lid comprises a first side and a second side spaced apart along the lateral direction, wherein the first side of the first lid comprises a first front follower and a first rear follower, wherein the first front follower is moveably mated within the first front guide, wherein the first rear follower is positioned along the axis of rotation, wherein the first rear follower is moveably mated within the first rear guide, wherein the second lid comprises a first side and a second side spaced apart along the lateral direction, wherein the first side of the second lid comprises a second front follower and a second rear follower, wherein the second front follower is moveably mated within the second front guide, wherein the second rear follower is positioned along the axis of rotation, wherein the second rear follower is moveably mated within the second rear guide.

4. The refrigerator appliance of claim 3, wherein the rotational damper comprises a first damper element at the second side of the first lid and a second damper element at the second side of the second lid, wherein the first damper element is extended from the first lid toward the second lid along the lateral direction, wherein the second damper element is extended from the second lid toward the first lid along the lateral direction, wherein the first damper element and the second damper element are positioned along the axis of rotation, and wherein the first damper element and the second damper element or rotatably mated.

5. The refrigerator appliance of claim 4, wherein either the first damper element or the second damper element comprises a barrel defining an opening, wherein the other of the first damper element or the second damper element comprises a pin rotatably mated within the opening of the barrel.

6. The refrigerator appliance of claim 4, wherein the second side of the first lid and the second side of the second lid define an unconstrained gap therebetween.

7. The refrigerator appliance of claim 3, wherein the first front guide comprises a first front locating rail extending along the transverse direction, wherein the first rear guide comprises a first rear locating rail extending along the transverse direction, wherein the second front guide comprises a second front locating rail extending along the transverse direction, wherein the second rear guide comprises a second rear locating rail extending along the transverse direction, wherein the first front follower, the first rear follower, the second front follower, and the second rear follower are moveably mated to the first front locating rail, the first rear locating rail, the second front locating rail, and the second rear locating rail, respectively, between the closed position and the tucked position.

8. The refrigerator appliance of claim 7, wherein the first front locating rail and the second front locating rail each comprise a front lip extending upward along the vertical direction, wherein the first rear locating rail and the second rear locating rail each comprise a rear lip extending downward along the vertical direction.

9. The refrigerator appliance of claim 8, wherein the first front follower and the second front follower each define a front notch at a bottom thereof, wherein each front notch is moveably mated onto a respective front lip, wherein the first rear follower and the second rear follower each define a rear notch at a top thereof, and wherein each rear notch is moveably mated onto a respective rear lip.

10. The refrigerator appliance of claim 7, wherein the first rear follower and the second rear follower each comprise a locking element extended outward along the lateral direction, wherein the first rear guide and the second rear guide each comprise a blocking element, wherein each locking element is rotatably mated within a respective blocking element between a free position and blocked position, wherein in the free position the first lid or the second lid, respectively, are capable of transitioning between the closed position and the tucked position, and wherein in the blocked position, the first lid or the second lid, respectively, are incapable of transitioning between the closed positioned and the tucked position.

11. A refrigerator appliance comprising:

a cabinet defining a chamber; and a storage drawer assembly positioned within the chamber, the storage drawer assembly comprising:

a drawer defining a storage compartment; and a lid assembly positioned above the drawer, the lid assembly comprising:

a cover positioned above the drawer, the cover comprising a first side support and a second side support;

a first lid moveably mated to the cover to selectively permit access to the storage compartment;

a second lid moveably mated to the cover to selectively permit access to the storage compartment, the first lid and the second lid defining an axis of rotation extending parallel to the lateral direction, the axis of rotation being positioned proximate to a rear of the lid assembly; and a rotational damper between the first lid and the second lid, wherein the rotational damper is positioned in line with the axis of rotation, wherein the first lid is rotatable about the axis of rotation independent of the second lid between a first closed position and a first flipped position, and wherein the second lid is rotatable about the axis of rotation independent of the first lid between a second closed position and a second flipped position.

12. The refrigerator appliance of claim 11, wherein the first lid or the second lid comprises a front follower and a rear follower, wherein the front follower is extended outward and positioned proximate the front of the lid assembly, wherein the rear follower is extended outward and positioned proximate the rear of the lid assembly, and wherein the rear follower is in line with the axis of rotation.

13. The refrigerator appliance of claim 12, wherein the first side support or the second side support comprises a front guide defining a front slot for receiving the front follower, wherein the first side support or the second side support comprises a rear guide defining a rear slot for receiving the rear follower.

14. The refrigerator appliance of claim 13, wherein the front guide comprises a front locating rail, wherein the rear guide comprises a rear locating rail, wherein the front follower is moveably mated to the front locating rail, and wherein the rear follower is moveably or rotatably mated to the rear locating rail.

15. The refrigerator appliance of claim 14, wherein the front guide comprises a first lip, wherein the rear guide comprises a second lip, wherein the first lip is extended upward from the front locating rail, wherein the second lip is extended downward from the rear locating rail, wherein the front follower defines a front notch at a bottom thereof for receiving the first lip, and wherein the rear follower defines a rear notch at a top thereof for receiving the second lip.

16. The refrigerator appliance of claim 11, wherein the rotational damper comprises a first damper element and a second damper element, wherein the first damper element is extended from one of the first lid or the second lid, and wherein the second damper element is extended from the other of the first lid or the second lid.

17. The refrigerator appliance of claim 16, wherein the first damper element comprises a pin, wherein the second damper element comprises a barrel defining an opening, and wherein the pin is rotatably coupled within the opening.

18. The refrigerator appliance of claim 11, wherein the first lid and the second lid are together moveable relative to the first side support and the second side support, respectively, between a closed position and a tucked position.

19. The refrigerator appliance of claim 11, wherein the first lid and the second lid are individually rotatable about the axis of rotation between a closed position and a flipped position.

* * * * *